US005802721A

United States Patent [19]

Wain et al.

[11] Patent Number: 5,802,721

[45] Date of Patent: Sep. 8, 1998

[54] SAFETY RAZORS

[75] Inventors: Kevin James Wain, Reading; Frank Edward Brown, Maidenhead, both of United Kingdom

[73] Assignee: The Gillette Company, Boston, Mass.

[21] Appl. No.: 745,324

[22] Filed: Oct. 16, 1996

Related U.S. Application Data

[63] Continuation of PCT/GB95/00777 Apr. 4, 1995.

[30] Foreign Application Priority Data

Apr. 21, 1994 [GB] United Kingdom ..... 9407896

[51] Int. Cl.[6] ..... B26B 21/06

[52] U.S. Cl. ..... 30/34.2; 30/50; 30/82

[58] Field of Search ..... 30/50, 77, 81, 30/82, 83, 34.2

[56] References Cited

U.S. PATENT DOCUMENTS

| | | | |
|---|---|---|---|
| 903,347 | 11/1908 | Watson . | |
| 954,871 | 4/1910 | Molkenthin . | |
| 1,247,266 | 11/1917 | Hartman . | |
| 1,357,863 | 11/1920 | Haggarty . | |
| 1,555,961 | 10/1925 | Gillette . | |
| 1,555,962 | 10/1925 | Gillette . | |
| 1,768,307 | 6/1930 | Bleloch et al. . | |
| 1,833,242 | 11/1931 | Connolly . | |
| 1,927,971 | 9/1933 | Youmans . | |
| 1,974,569 | 9/1934 | Grotenhuis . | |
| 1,995,232 | 3/1935 | Tipery . | |
| 2,043,998 | 6/1936 | Hadjopoulos . | |
| 2,083,579 | 6/1937 | Schmitt | 30/34.2 |
| 2,126,728 | 8/1938 | Buell . | |
| 2,178,976 | 11/1939 | Te Pas | 30/34.2 |
| 2,181,038 | 11/1939 | Wimberger | 30/34.2 |
| 2,750,663 | 6/1956 | Coles . | |
| 2,766,521 | 10/1956 | Benvenuti . | |
| 2,778,104 | 1/1957 | Coles | 30/77 |
| 2,807,084 | 9/1957 | Harman . | |
| 3,004,337 | 10/1961 | Schweizer | 30/77 |
| 3,138,865 | 6/1964 | Meyer | 30/34.2 |
| 3,722,090 | 3/1973 | Dawidowicz | 30/34.2 |
| 3,871,073 | 3/1975 | Nissen et al. | 30/34.2 |
| 3,909,939 | 10/1975 | Dootson | 30/34.2 |
| 4,044,463 | 8/1977 | Tietjens | 30/34.2 |
| 4,069,580 | 1/1978 | Cartwright et al. . | |
| 4,189,832 | 2/1980 | Harper et al. | 30/34.2 |
| 4,241,501 | 12/1980 | Westlake . | |
| 4,247,982 | 2/1981 | Booth et al. | 30/83 |
| 4,409,735 | 10/1983 | Cartwright et al. . | |
| 4,443,939 | 4/1984 | Motta et al. . | |
| 4,516,320 | 5/1985 | Pelekis | 30/50 |
| 4,720,917 | 1/1988 | Solow . | |
| 4,741,103 | 5/1988 | Hultman | 30/34.2 |

(List continued on next page.)

FOREIGN PATENT DOCUMENTS

| | | | |
|---|---|---|---|
| 105333 | 1/1927 | Austria . | |
| 972139 | 8/1975 | Canada | 30/47 |
| 29888 | 7/1922 | Denmark . | |
| 94128 | 11/1983 | European Pat. Off. | 30/34.2 |
| 300478 | 1/1989 | European Pat. Off. . | |
| 594695 | 5/1994 | European Pat. Off. . | |
| 815699 | 7/1937 | France . | |
| 75-06985 | 12/1976 | Netherlands | 30/34.2 |
| 75076 | 8/1917 | Switzerland . | |
| 11797 | 7/1847 | United Kingdom . | |
| 187475 | 10/1922 | United Kingdom . | |
| 2119690 | 11/1983 | United Kingdom . | |
| WO-93/01918 | 2/1993 | WIPO | 30/49 |

*Primary Examiner*—Douglas D. Watts
*Attorney, Agent, or Firm*—Charles P. Boukus, Jr.; Edward S. Podszus

[57] ABSTRACT

A shaving unit includes a skin engagement surface member for contact with the skin in advance of a blade edge and defined by a series of resiliently mounted elements (9) defining between them slots (10) through which hairs can pass while being subjected to a light pulling force to increase the length of hair projecting from the skin prior to cutting. The skin engagement surface member may be a guard of the shaving unit or it can be mounted between two blades.

29 Claims, 6 Drawing Sheets

U.S. PATENT DOCUMENTS

| | | | |
|---|---|---|---|
| 4,754,548 | 7/1988 | Solow . | |
| 4,854,043 | 8/1989 | Chen . | |
| 4,976,028 | 12/1990 | Chen . | |
| 5,003,694 | 4/1991 | Chen . | |
| 5,185,927 | 2/1993 | Rivers | 30/50 |
| 5,205,040 | 4/1993 | Werner | 30/50 |
| 5,313,705 | 5/1994 | Rivers et al. | 30/50 |
| 5,351,401 | 10/1994 | Werner | 30/50 |
| 5,475,923 | 12/1995 | Ferraro | 30/51 |

SAFETY RAZORS

This is a continuation of International Application No. PCT/GB95/00777, with an international filing date of Apr. 4, 1995.

This invention relates to safety razors and in particular the invention is concerned with a shaving unit having one or more elongate blades and a skin engaging member for contacting the skin in advance of a blade edge. The shaving unit may be the head of a disposable razor having a handle to which the head is permanently attached, the entire razor being discarded when the blade(s) have become dulled, or the shaving unit may be a cartridge for replaceable mounting on a re-usable razor handle.

In general a shaving unit has a guard for contacting the skin in advance of the blade edge(s) as the blades are moved across the skin during shaving, and a cap for contacting the skin behind the blade edge(s). Many different surface configurations and materials have been proposed for the guard surface. Thus guards have been designed to stretch the skin ahead of the blade, or to impart pleasant tactile sensations to the skin as the guard slides across its surface.

Shaving units are usually substantially rigid, whereby the blade edges remain substantially straight. There has been proposed, however, a flexible shaving cartridge adapted to bend in a plane essentially perpendicular to the plane of the blades. In order to achieve the desired flexibility of the guard it is defined by several separate segments individually mounted on blade supports. Such a cartridge is disclosed in PCT/US92/05467, according to which the segments are shaped and mounted to preclude entry of skin into the spaces left between the segments. The guard segments are not adapted to prepare hairs for severing.

The present invention has for its aim to provide a shaving unit with improved shaving performance by preparing hair to be severed in advance of a blade edge.

According to the invention there is provided a shaving unit comprising an elongate skin engagement surface for contacting the skin in advance of a blade edge moved across the skin during shaving, said surface being defined by elements with gaps therebetween for hairs to pass through, laterally adjacent elements being formed and spaced to engage resiliently hairs passing through the gaps therebetween for applying a light pulling force to the hairs as the skin from which the hairs project slides over the surface. A preferred embodiment of a shaving unit in accordance with the invention comprises an elongate skin engagement surface defined by a multiplicity of elements disposed along the surface and confining therebetween through-slots extending from the leading edge to the trailing edge of said surface, the width of each slot tapering rearwardly from the mouth thereof at the leading edge and having minimum value less than the diameter of a hair, and the surface elements being resiliently movable relative to each other substantially in the plane of said surface. In use of such a shaving unit, many of the hairs protruding from the skin passing across the skin engagement surface enter the slots and because the surface elements must be deflected by the hairs to enable them to pass through the narrowest slot portions, the hairs are subjected to a pulling force. This pulling force increases the length by which the hair projects from the skin and, as there is a delay before the hair will retract again after being pulled, the closeness of shave obtained may be improved due to the cutting edge of the blade slicing through the hair while it is still extended. In order for the exposed length of a hair to be increased only a relatively light pulling force is needed. For example, a pull of only 1 gm can extend a hair by as much as 100 $\mu$m. If, on the other hand, a high pulling force is exerted on a hair it can cause unpleasant sensations, if not discomfort. It is preferred that the surface elements be arranged to exert a pulling force in the range of approximately 0.5 to 20 gms, to ensure significant extension without causing discomfort, and most preferably the pulling force exerted on a hair is not greater than 10 grms, e.g. substantially equal to 5 gms. It is ensured that uncut hairs do not become trapped between the surface elements, and hence do not become pulled so hard that discomfort results, by the surface elements releasing the hairs allowing them to pass out of the slots at the trailing edge of the skin engagement surface. This release of the hairs is reliably achieved by the adjacent elements being able to move apart, due to their spring mountings, to widen the slots sufficiently to allow the hairs to pass easily through.

It is preferable for the majority of the hairs to pass through the slots and preferably the slot width of the mouths of the slots is not less than the width of the surface elements at the leading edge of the skin engagement surface. In a particular embodiment the mouth slot width is in the range of 1 to 2 times, e.g. approximately 1.5 times the width of the elements at the leading edge. A slot mouth width in the order of 0.50 mm is appropriate, i.e. several times greater than a typical hair diameter of 0.10 mm.

The minimum slot width is preferably at the trailing edge of the skin engagement surface, that is closest to the cutting edge of the following blade. A minimum slot width in the order of 0.05 mm has been found appropriate.

So that the majority of hairs will pass through the slots, a large number of slots is preferably provided. Preferably the slots are spaced uniformly apart and at a pitch of not more than 1.2 mm, preferably in the range of 0.7 to 1.0 mm.

The skin engagement surface is conveniently formed by a member, e.g. made of metal, having the general form of a comb, the spine part of which forms a front wall lying substantially perpendicular to the skin engagement surface defined by the comb teeth constituting the surface elements. The resilience of the surface elements is provided by twisting of the torsion springs formed by the root portions which connect the teeth to the spine part. In this embodiment the surface elements are in effect cantilever mounted by the torsion springs and some movement substantially perpendicular to the skin engagement surface may be permitted at their free trailing ends, which might be useful in dislodging cut hair remnants from the slots. So that there is a stronger tendency for the hairs to enter the mouths of the slots, than for the hairs to be flattened against the skin by the skin engagement surface, it is preferable for there to be a relatively sharp transition from the skin engaging surface to the front wall. A radius of curvature in the order of 0.16 mm has been found appropriate at this edge.

In a modified form of such an embodiment, the teeth are carried by respective springs integrally connected to the trailing ends of the teeth. The springs can be L-shaped and extend rearwardly from the upper edge of a front wall and then upwardly to the teeth. Movement of the teeth to widen the slots is permitted by torsional twisting of the rearwardly extending, spring portions. The springs can also act as leaf springs providing a spring mounting for the teeth to enable some resilient displacement generally perpendicular to the plane of the skin engagement surface.

According to an alternative construction the skin engagement surface is formed by a moulded plastics member including surface elements carried on respective parallel leaf springs enabling resilient lateral deflection of the surface elements. The slots defined between the surface elements are preferably shaped and dimensioned as discussed above.

The skin engagement surface may be the guard surface of the shaving unit, i.e. be positioned to contact the skin immediately in front of the blade of a single blade razor, or the leading blade in the case of a razor having two or more blades arranged in succession. Alternatively, the skin engagement surface may be arranged to contact the skin behind the leading blade of a multiple blade shaving unit, e.g. in advance of the second blade in a twin blade shaving unit.

A more complete understanding of the invention will be gained from the following description given with reference to the accompanying drawings, in which.

Figure 1:
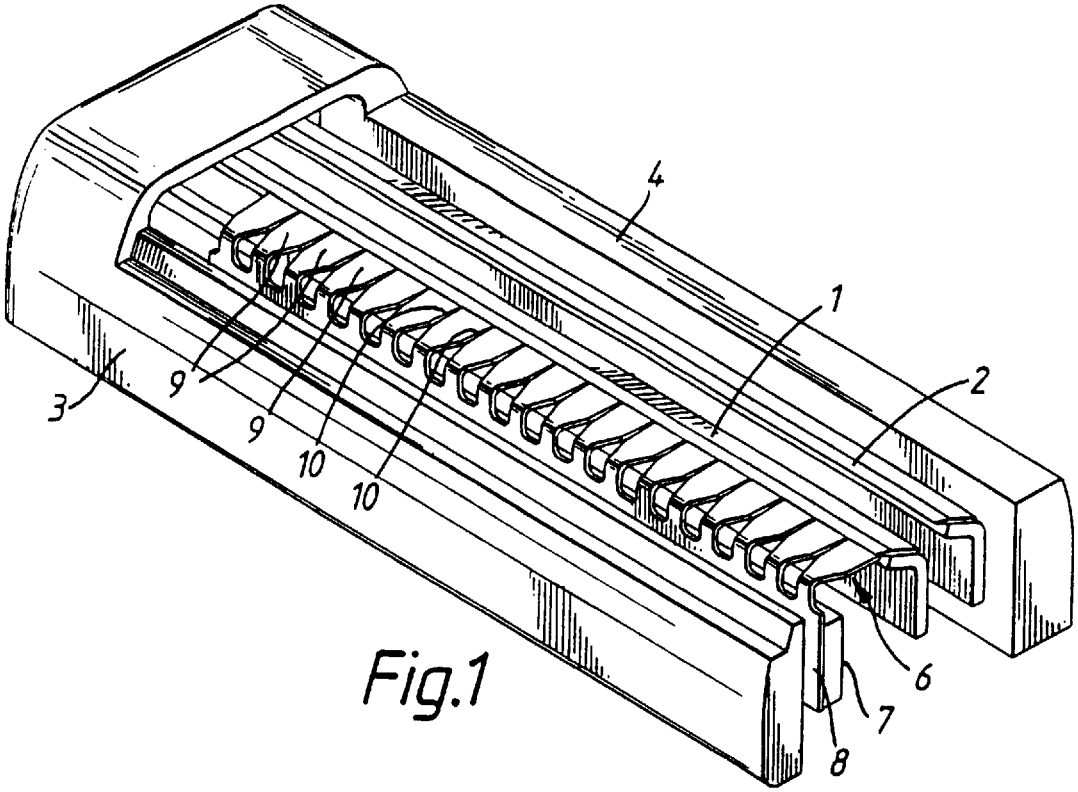
FIG. 1 shows in perspective view an end portion of a shaving unit in accordance with the invention.

The shaving unit shown in FIG. 1 may be a cartridge for detachable mounting on a reusable handle, or may be fixed to the handle of a disposable razor. It comprises two blades 1,2 mounted in tandem in a carrier frame 3 which may define the cap 4 of the shaving unit, or could have a separate cap member mounted thereon. The shaving unit also includes a guard member 6 defining a skin engagement surface for contacting the skin being shaved directly in front of the cutting edge of the leading blade 1. The guard member is supported by a longitudinal bar 7 integral with or otherwise fixed to the frame 3. The guard member has the form of an integral comb with a spine defining a front wall 8 attached to the support bar 7, and a multitude of substantially identical teeth 9 which are bent over at substantially 90° to the front wall and define the upwardly facing skin engagement surface. The trailing edge of the skin engagement surface may terminate at a short distance in front of the cutting edge of the leading blade 1 or be positioned to underlie the cutting edge on the side of the blade which is remote from the skin during shaving.

Figure 2:
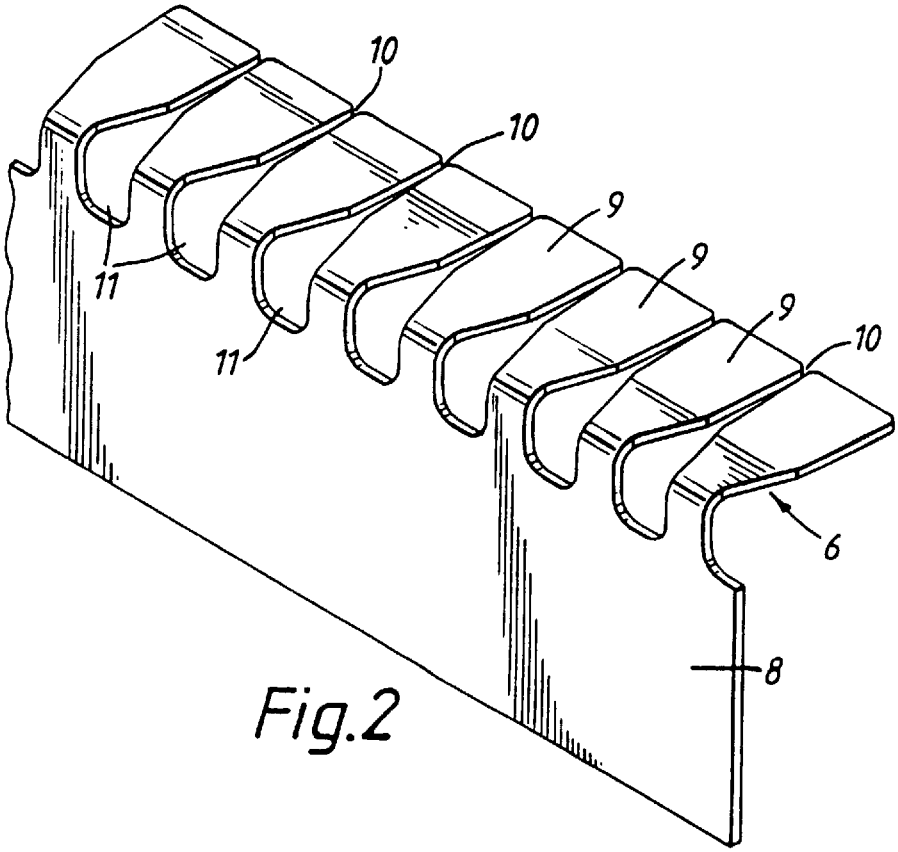
FIG. 2 shows on an enlarged scale a portion of the guard member of the shaving unit shown in FIG. 1.

As may be best seen in FIG. 2, the teeth confine between them slots 10 which at the leading edge bf the guard surface register with U-shaped notches 11 extending downwardly into the front wall. The width of each of the slots 10 is a maximum 0.50 mm, at the mouth of the slot at the leading edge of the skin engagement surface. The slot tapers inwardly at a relatively sharp angle over a first portion of the slot, and then continues to taper at a very shallow angle to define a minimum slot width of 0.05 mm at the trailing edge of the skin engagement surface. The width of the teeth at their trailing ends is 0.8 mm, giving a slot pitch of 0.85 mm, and the width of the teeth roots is 0.35 mm. The length of the teeth between the leading and trailing edges of the skin engagement surface is 1.6 mm. The metal foil or other sheet material from which the guard member is made has a thickness of 0.08 mm. In manufacture the guard member can be initially formed flat and then be bent at a small radius of curvature, e.g. 0.16 mm, so that the teeth lie substantially perpendicular to the front face.

In use of the shaving unit, the guard surface slides over the skin in front of the leading blade edge. The majority of the hairs protruding from the skin enter the slots 10 and are guided along the slots. As a hair, having a typical diameter of 0.10 mm, approaches the narrowest slot portion it becomes gripped lightly between the two teeth on either side of the slot. As the hair continues its path through the slot, it cams the teeth apart, this resilient movement being permitted by twisting of the teeth roots which serve as torsion springs. The teeth exert a pulling action on the hair, with a force of 0.5 to 20 gms, e.g. 5 gms, tending to withdraw the hair from the skin. The hair becomes released at the trailing edge of the guard member and meets the cutting edge of the following blade before it has had time to retreat back into the skin. The forces exerted on the hairs are not great enough to cause discomfort. If the guard surface does not terminate in front of the blade and the trailing edge of this surface, defined by the free ends of the teeth, underlies the cutting edge of the blade, hairs will still be located in the slots, and hence subject to the pulling causing them to be extended from the skin when they are contacted and cut through by the blade.

Figure 3:
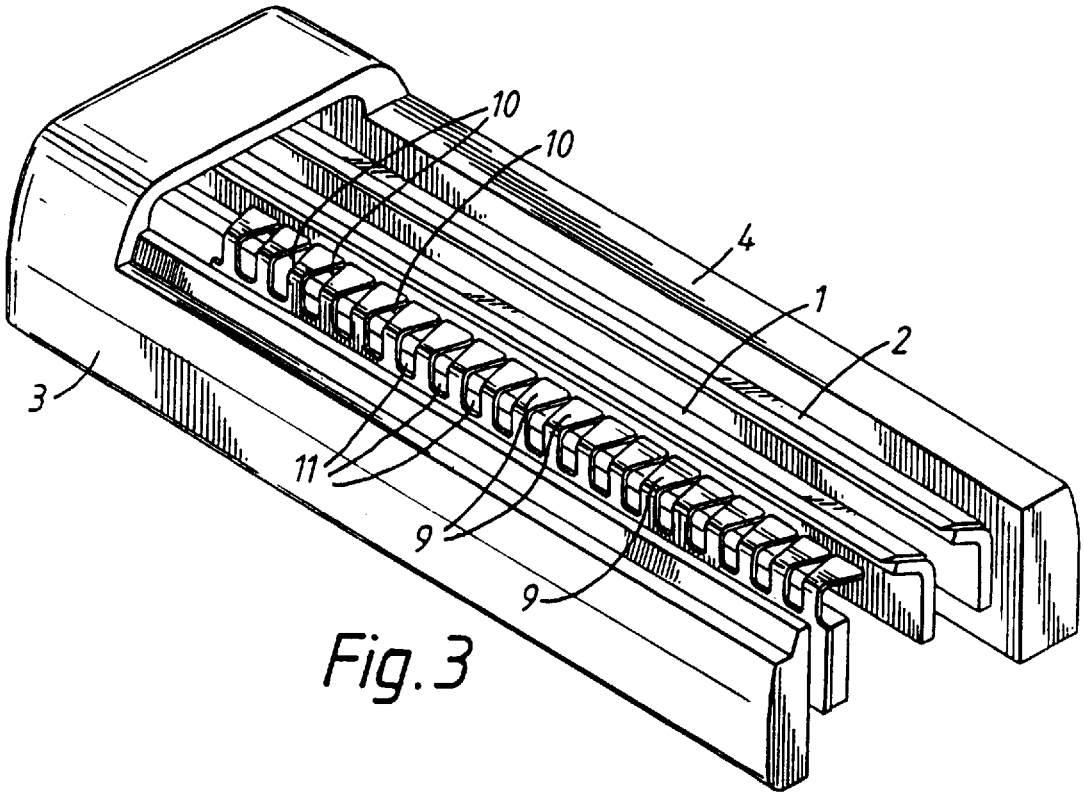
FIG. 3 is a view similar to FIG. 1 showing a modified shaving unit embodying the invention.

The embodiment shown in FIG. 3 is basically the same as that of FIGS. 1 and 2, except that the teeth defining the skin engagement surface are shorter in length, and the sides of the slots have a constant taper. The slot widths at the leading and trailing edges of the guard surface, and the other dimensions may be as specified for the first embodiment.

Modifications are possible without departing from the inventive concept. For example it is not necessary for the guard member to be made in one piece, and it might be assembled from two parts fastened together and each providing alternate teeth along the guard surface. Also, it is not essential for the front wall 8 of the comb to be perpendicular to the skin engaging surface and it could for example be arranged to extend at an acute angle to the plane of the teeth 9, and/or be offset rearwardly from the front edge of the skin engaging surface, e.g. by bending the front wall to extend rearwardly and then downwardly.

Figure 4:
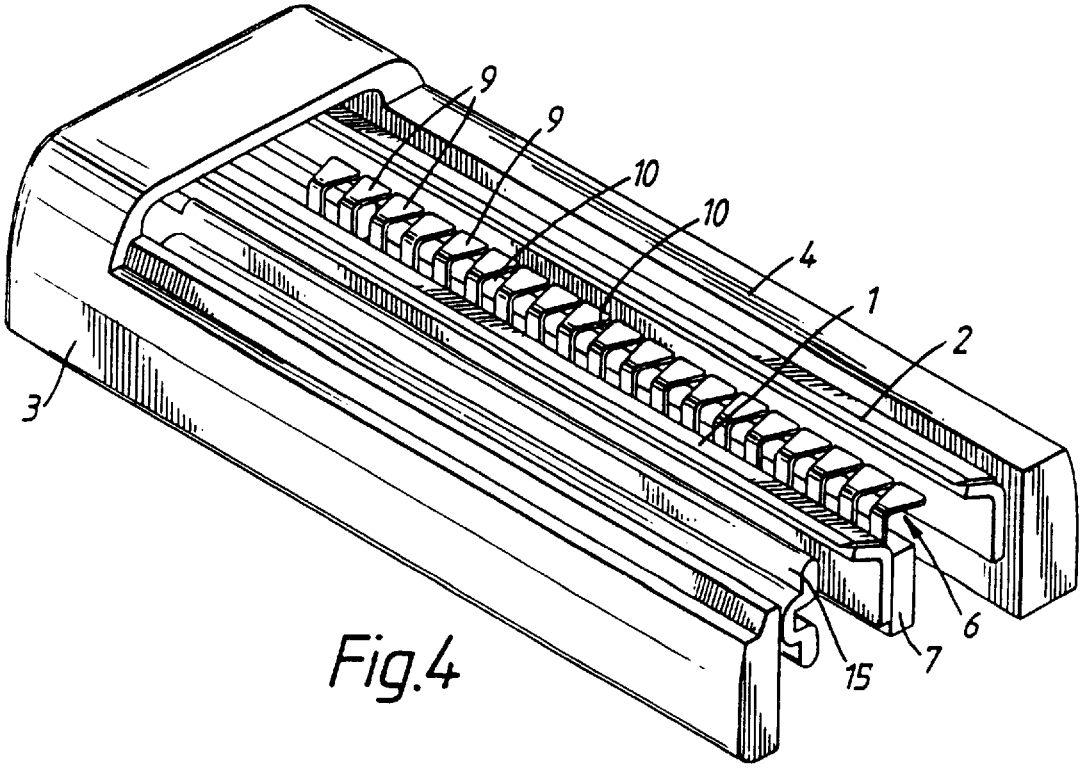
FIG. 4 is a view similar to FIG. 1 showing another embodiment of the invention.

In the embodiments described above the slotted skin engagement surface is the guard surface. Alternatively, or in addition, in a shaving unit having two or more blades such a slotted skin contacting surface may be located immediately ahead of the second or a later blade. In FIG. 4 there is illustrated an embodiment of such a shaving unit. This shaving unit has two blades and a comb-like member 6, of essentially the same form as the guard of the shaving unit shown in FIG. 3, is arranged between the blades to define the slotted skin engagement surface behind the leading blade 1 and in front of the cutting edge of the second blade 2. The member 6 may be as described above in relation to the embodiments of FIGS. 1 to 3. Although the shaving unit is shown to have a conventional guard 15, a slotted guard could be provided so that slotted skin engaging surfaces are defined before each blade edge. With an interblade skin contacting member as shown in FIG. 4, it is preferable for the distance between the leading and trailing edges of the slotted surface, and hence the length of the surface defining elements to be not greater than about 1.0 mm.

Figure 5:
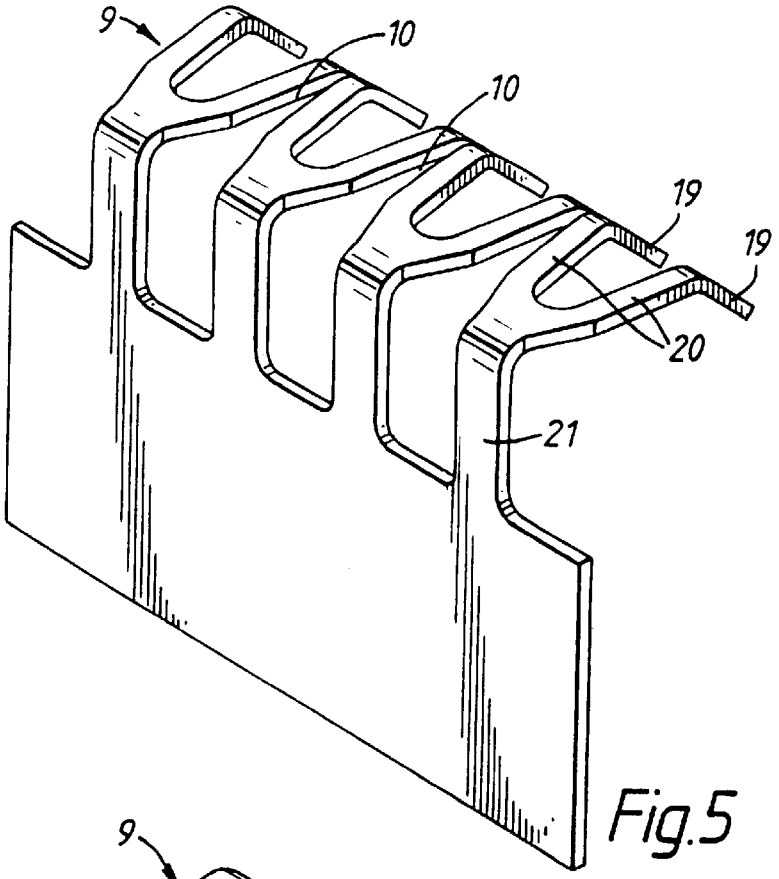
FIGS. 5 and 6 show in perspective sections of respective modified forms of the skin engagement surface member of FIGS. 1 and 2.

The skin engagement surface member of FIG. 5 is basically the same as that of FIGS. 1 and 2, and the same reference numerals have been used to designate corresponding parts in the drawings. The main differences are that the teeth 9 are extended rearwardly by down-turned tail portions 19, the slot sections defined between the tail portions of adjacent teeth being of substantially constant width, and the teeth are bifurcated. When the member is mounted in a shaving unit, the tail portions 19 can extend beneath a following blade edge without adverse effect on the hair cutting performance of that edge. The bifurcated form of the teeth gives them a Y shape as seen in plan. The divergent prongs 20 may be stiff so that lateral deflection caused by hairs passing through the slots 10 is due to the torsion springs formed by the leg portions 21 carrying the teeth as in the embodiments described above, or the prongs 20 can be resilient so that at least some of their lateral deflection is due to resilient flexing of the prongs. The pitch and dimensions of the slots may be as described above with reference to FIGS. 1 and 2.

Figure 6:
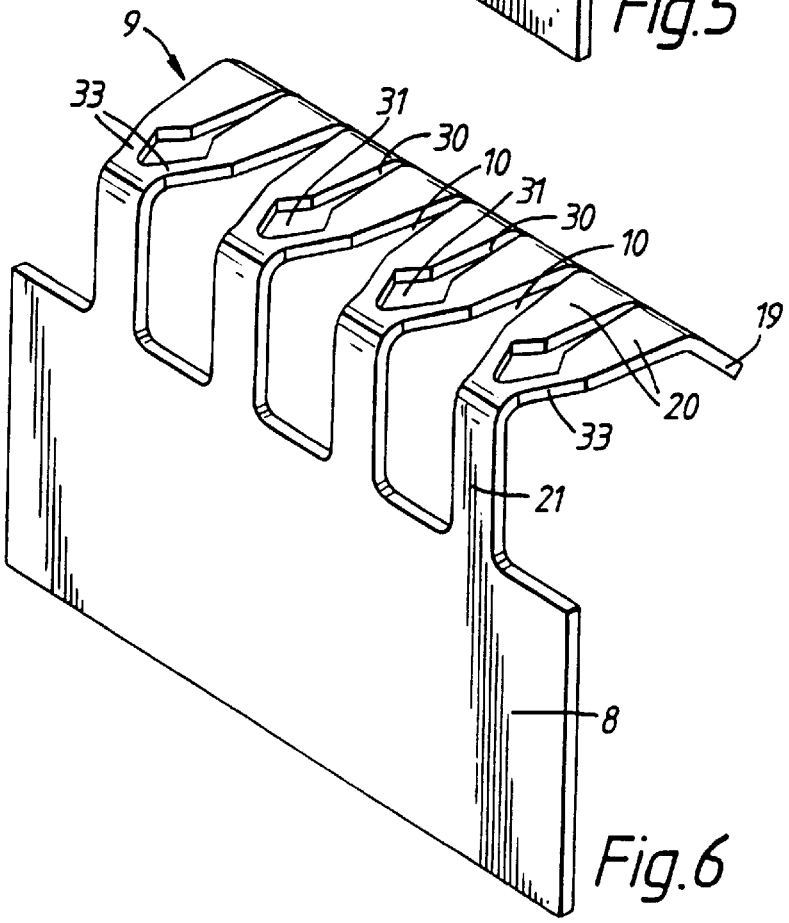

The modified skin engagement surface member illustrated in FIG. 6 is similar to that of FIG. 5, but the prongs 20 of each tooth are shaped to form an additional rearwardly convergent slot 30 and a diamond shaped hole 31 at the forward end of this slot. Hairs which fail to enter the slots 10 between the teeth may enter these additional slots 30 and be subject to a light pulling force due to these hairs being gripped lightly between the prongs 20. The narrow forward end portions 33 of the prongs can provide the resilience needed to allow the prongs to spread apart a little to allow hairs to pass through the additional slots 30.

Figure 7:
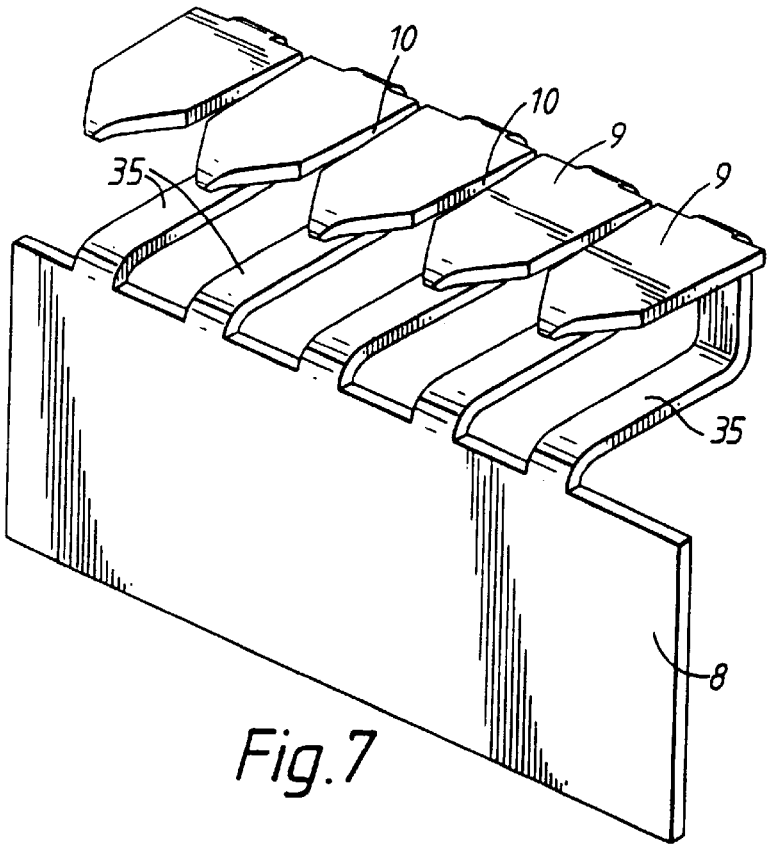
FIG. 7 is a front perspective view showing a section of another modified form of skin engagement surface member.
Figure 8:
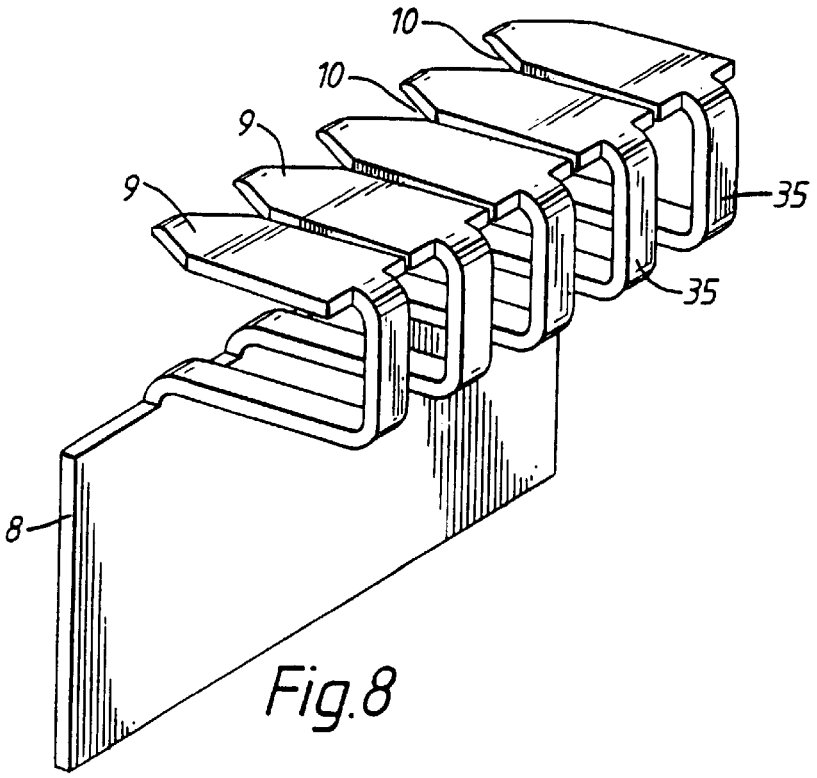
FIG. 8 is a rear perspective view of the skin engagement member of FIG. 7.

FIGS. 7 and 8 illustrate another modified embodiment of a skin engaging member of the general form described with reference to FIGS. 1 and 2. In this embodiment the teeth 9, between which the rearwardly tapering slots 10 are defined, are carried by respective L-shaped springs 35 integrally connected to the trailing ends of the teeth. The springs extend rearwardly from the upper edge of a front wall 8 and then upwardly to the teeth. The leading ends of the teeth have narrow tips, to encourage hairs to enter the mouths of the slots 10, and the upper surfaces of the tips are chamfered for enhanced comfort during shaving. The slots 10 may be shaped and dimensioned as described in relation to FIGS. 1 and 2. In use, when the skin engagement surface member is mounted in a shaving unit, e.g. as in FIG. 1 or FIG. 4, hairs will enter the slots 10, become lightly gripped between the teeth and hence experience a controlled pulling force. The teeth can move laterally to increase the slot width due to the rearwardly extending portions of the springs 35 acting as torsion springs. With this embodiment, the springs 35 can also serve as leaf springs to permit a degree of resilient displacement of the teeth substantially perpendicular to the skin engagement surface, which may be advantageous, especially if the blades of the shaving unit are themselves spring mounted.

Figure 9A:
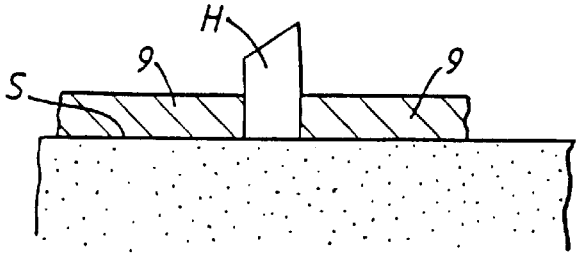
FIGS. 9A to 9D are detailed cross-sectional views illustrating different slot edge forms for the embodiments of FIGS. 1 to 8.
Figure 9B:
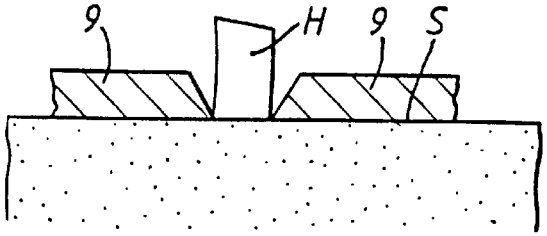
Figure 9C:
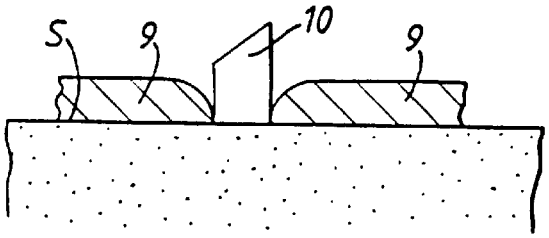
Figure 9D:
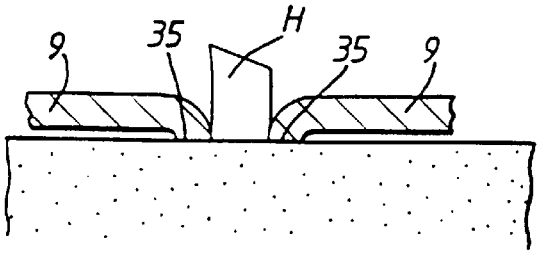

All the skin engagement surface members of FIGS. 1 to 8 may be initially formed substantially flat and then shaped by bending. Different manufacturing techniques are possible for producing the slots, e.g laser cutting, stamping and coining, electro forming, and spark erosion, and the confronting lateral edges of the adjacent teeth may differ in orientation according to the method employed. FIG. 9A shows a hair H gripped between teeth edges substantially perpendicular to the skin engaging surface S. Alternatively, the edge surfaces may converge towards the skin engaging surface S as illustrated in FIG. 9B, or the teeth edges can be rounded as shown in FIG. 9C. As shown in FIG. 9D the teeth have rounded edges which are undercut so that ridges 35 extend over the skin and engaging surface S alongside the slots.

Figure 10:
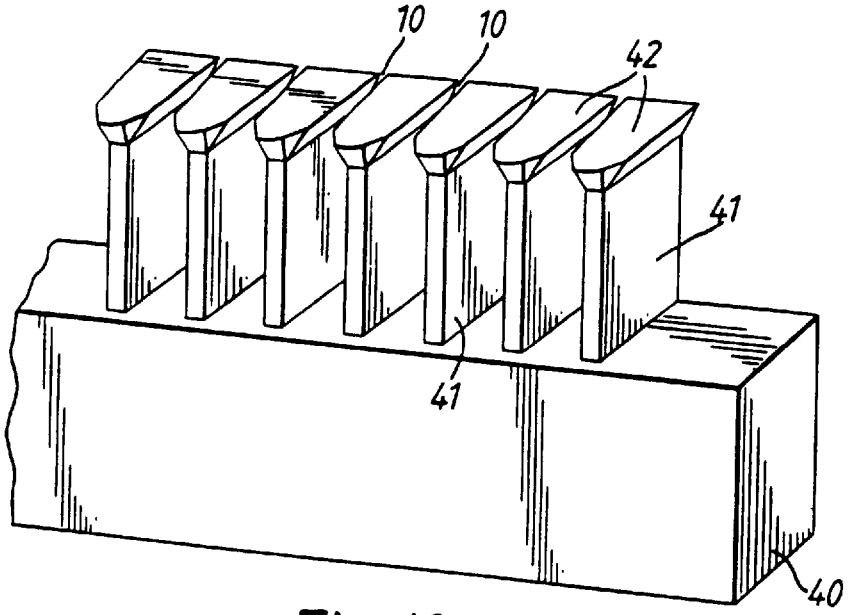
FIGS. 10 and 11 show alternative forms of skin engagement members for shaving units embodying the invention.
Figure 11:
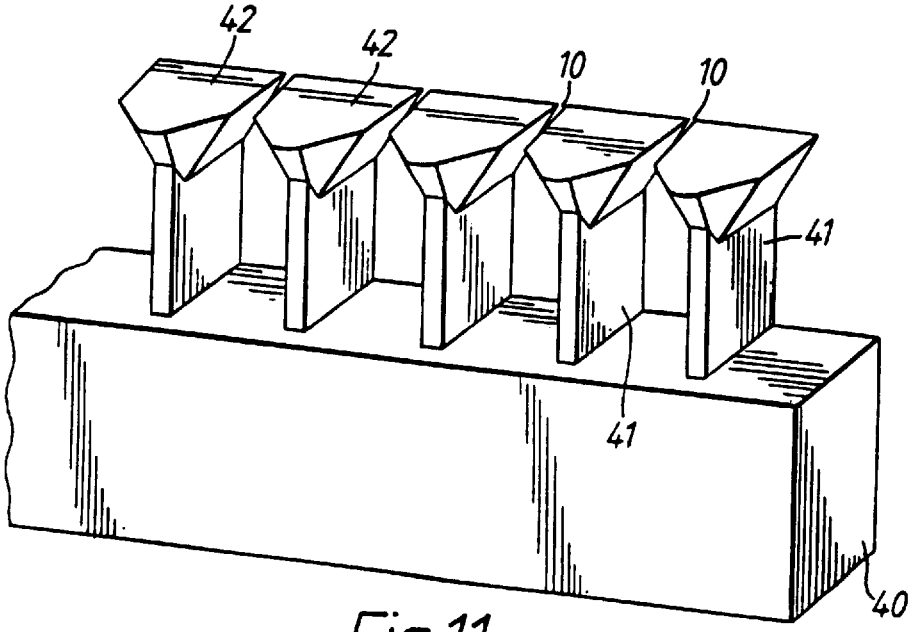

Skin engagement surface members of a different construction to those described above are illustrated in FIGS. 10 and 11. These members can be moulded from plastics and in each case the member comprises a carrier beam 40 with a series of uniformly spaced parallel leaf springs 41 extending upwardly from the beam. Mounted on the upper end of each leaf spring is an integral surface element or pad 42. The pads are shaped to define slots 10 with relatively sharply convergent entrance portions and followed by gradually tapering portions having a minimum width less than the diameter of a hair. The entrance portions guide hairs into the slots so that they are gripped between and lightly pulled by adjacent pads which, due to their leaf spring mountings can move laterally to widen the slot to allow the hair to pass through. As illustrated the confronting side faces of adjacent pads 42 are inclined to converge towards the skin contacting surface but this is not essential. The slot dimensions may be as described above in relation to other embodiments but it should be understood that in all embodiments the slot dimensions and the spring rate of the springs will be selected to obtain the desired order of magnitude pulling force to be exerted against hairs passing through the slots. The skin engagement surface members of FIGS. 10 and 11 differ only in the shape and size of the pads 42.

Any of the skin engagement surface members described above may be mounted resiliently in the frame of a shaving unit. For example, the member could be acted upon adjacent its ends by spring fingers urging the member to an uppermost position and allowing the member to move downwardly under forces exerted against the skin engaging surface as may be experienced during shaving.

We claim:

1. A shaving unit comprising an elongate skin engagement surface for contacting the skin in advance of a blade edge moved across the skin during shaving, said surface being defined by a series of elements (9;42) defining slots (10) therebetween, characterized in that the slots (10) are arranged for hairs to pass through the slots, and laterally adjacent elements (9;42) are formed and spaced apart along the surface to engage resiliently hairs passing through the slots therebetween for applying a light pulling force to the hairs as the skin from which the hairs project slides over the surface, wherein each of the slots extends from a leading edge to a trailing edge of said surface, the width of each slot tapers rearwardly from the mouth thereof at the leading edge and has a minimum value less than the diameter of a hair, and the adjacent elements are resiliently movable relative to each other substantially parallel to the plane of said surface in response to passage of the hairs through the slots, the hairs passing through the slots being gripped between the adjacent elements to extend the hairs from the skin and the hairs being released at the trailing edge of said surface to meet the blade edge before retracting into the skin.

2. A shaving unit according to claim 1, wherein the adjacent elements exert a pulling force on the hairs in the range of 0.5 to 20 gms.

3. A shaving unit according to claim 2, wherein the adjacent elements exert a pulling force on a hair substantially equal to 5 gms.

4. A shaving unit according to claim 1, wherein the slots (10) have a minimum width at the trailing edge of the surface.

5. A shaving unit according to claim 1, wherein the slots (10) have a minimum width substantially equal to 0.05 mm.

6. A shaving unit according to claim 1, wherein the slots (10) are positioned at a uniform pitch of not more than 1.20 mm.

7. A shaving unit according to claim 6, wherein the pitch is in the range of 0.70 to 1.00 mm.

8. A shaving unit according to claim 1, wherein the slot width at the mouth thereof is not less than the width of the surface elements at the leading edge of the surface.

9. A shaving unit according to claim 8, wherein the slot width at the slot mouth is approximately 1.5 times the width of the surface elements at the leading edge of the surface.

10. A shaving unit according to claim 9 wherein the slot width at the slot mouth is substantially 0.50 mm.

11. A shaving unit according to claim 1, wherein the elements (9) are substantially planar elements.

12. A shaving unit according to claim 1, wherein the elements (9) are provided by respective teeth of a unitary comb-like member (6).

13. A shaving unit according to claim 12, wherein the comb-like member (6) is made of sheet material and the teeth have a thickness in the order of 0.08 mm.

14. A shaving unit according to claim 1, wherein the surface elements (9) are supported by respective springs.

15. A shaving unit according to claim 14, wherein the surface elements are supported by respective torsion springs connected to the elements at the leading edge of said surface.

16. A shaving unit according to claim 15, wherein the skin engagement surface adjoins a front wall (8) at the leading edge, said front wall having notches (11) registering with the slots and separating connecting strips constituting said torsion springs.

17. A shaving unit according to claim 1, wherein the leading edge of the skin engagement surface adjoins a front surface extending substantially perpendicularly to the skin engagement surface, there being a sharp edge transition between said surfaces.

18. A shaving unit according to claim 14, wherein the elements (9) have tail portions (19) inclined away from the skin engagement surface.

19. A shaving unit according to claim 14, wherein the elements (9) are bifurcated with rearwardly extending prongs (20).

20. A shaving unit according to claim 19, wherein the prongs (20) of each element define an additional slot (30) through which hairs can pass and be engaged resiliently by the prongs to be subject to light pulling forces.

21. A shaving unit according to claim 14, wherein the surface elements (9) are supported by respective springs (35) connected to the elements at the trailing edge of said surface.

22. A shaving unit according to claim 21, wherein the springs (35) extend rearwardly and then upwardly to the surface elements.

23. A shaving unit according to claim 22, wherein rearwardly extending portions of said springs (35) act as torsion springs allowing relative lateral movement between adjacent elements.

24. A shaving unit according to claim 22 wherein the surface elements have pointed tips at their forward ends.

25. A shaving unit according to claim 1, wherein the surface elements (42) are carried on respective parallel leaf springs (41).

26. A shaving unit according to claim 25, wherein the surface elements (42) and the leaf springs (41) are integrally moulded with an elongate support member (40).

27. A shaving unit according to claim 1 including a frame in which a member defining the skin engagement surface is supported by spring means enabling resilient displacement of the member generally perpendicular to said surface.

28. A shaving unit according to claim 1 wherein the skin engaging surface is the guard surface of the shaving unit.

29. A shaving unit according to claim 1, wherein the skin engaging surface is located behind a leading blade edge and in front of the cutting edge of a further blade (2) of the shaving unit.

* * * * *